US006797971B2

(12) United States Patent
Cekic et al.

(10) Patent No.: US 6,797,971 B2
(45) Date of Patent: Sep. 28, 2004

(54) APPARATUS AND METHOD PROVIDING SUBSTANTIALLY TWO-DIMENSIONALLY UNIFORM IRRADIATION

(75) Inventors: Miodrag Cekic, Bethesda, MD (US); Boris Geller, Germantown, MD (US)

(73) Assignee: Fusion UV Systems, Inc., Gaithersburg, MD (US)

( * ) Notice: Subject to any disclaimer, the term of this patent is extended or adjusted under 35 U.S.C. 154(b) by 0 days.

(21) Appl. No.: 10/196,954

(22) Filed: Jul. 18, 2002

(65) Prior Publication Data

US 2004/0011969 A1 Jan. 22, 2004

(51) Int. Cl.[7] ..... G01N 21/01; G01N 21/05; G02B 5/10

(52) U.S. Cl. ..... 250/504 R; 250/453.11; 250/454.11; 250/455.11; 422/24

(58) Field of Search ..... 250/435, 436, 250/437, 453.11, 454.11, 455.11, 492.1, 504 R; 350/293, 296, 294; 362/3; 422/24

(56) References Cited

U.S. PATENT DOCUMENTS

| | | | | |
|---|---|---|---|---|
| 4,010,374 A | | 3/1977 | Ramler | |
| 4,048,490 A | | 9/1977 | Troue | |
| 4,276,479 A | | 6/1981 | Mibu et al. | |
| 4,297,583 A | | 10/1981 | Nerod | |
| 4,348,105 A | | 9/1982 | Caprari | |
| 4,503,086 A | | 3/1985 | Schultz | |
| 4,726,949 A | | 2/1988 | Miripol et al. | |
| 4,812,957 A | | 3/1989 | Hill | |
| 4,948,980 A | * | 8/1990 | Wedekamp | 250/504 R |
| 5,130,553 A | | 7/1992 | Amoh | |
| 5,133,932 A | | 7/1992 | Gunn et al. | |
| 5,176,782 A | | 1/1993 | Ishibashi et al. | |
| 5,211,467 A | | 5/1993 | Seder | |
| 5,269,867 A | | 12/1993 | Arai | |
| 5,440,137 A | | 8/1995 | Sowers | |
| 5,494,576 A | | 2/1996 | Hoppe et al. | |
| 5,635,133 A | | 6/1997 | Glazman | |
| 5,699,185 A | | 12/1997 | MacDonald | |
| 5,760,408 A | | 6/1998 | Kikuchi et al. | |
| 5,817,276 A | | 10/1998 | Fencl et al. | |
| 5,839,078 A | | 11/1998 | Jennings et al. | |
| 5,898,809 A | | 4/1999 | Taboada et al. | |
| 5,922,605 A | | 7/1999 | Feurstein et al. | |
| 5,932,886 A | | 8/1999 | Arai et al. | |
| 5,973,331 A | | 10/1999 | Stevens et al. | |
| 6,124,600 A | | 9/2000 | Moroishi et al. | |
| 6,128,030 A | | 10/2000 | Kikuchi et al. | |
| 6,190,016 B1 | | 2/2001 | Suzuki et al. | |
| 6,323,601 B1 | * | 11/2001 | Klein et al. | 315/248 |

* cited by examiner

*Primary Examiner*—John R. Lee
*Assistant Examiner*—David A. Vanore
(74) *Attorney, Agent, or Firm*—Antonelli, Terry, Stout & Kraus, LLP

(57) ABSTRACT

Apparatus for providing substantially two-dimensionally uniform irradiation of a relatively large planar target surface. Each of at least two substantially identical sources of radiation irradiate the target surface. The longitudinal axes of the sources of radiation are substantially parallel with each other, defining a plane substantially parallel to the target surface. Each of the sources of radiation is within a respective elongated elliptical reflecting trough and is spaced from the focal axis of the respective trough. Each trough terminates in an opening defining a rectangular plane substantially perpendicular to the major axis of the trough and substantially parallel to the longitudinal axis of the bulb.

74 Claims, 11 Drawing Sheets

X POSITION ON TARGET SURFACE

Y POSITION ON TARGET SURFACE

APPARATUS AND METHOD PROVIDING SUBSTANTIALLY TWO-DIMENSIONALLY UNIFORM IRRADIATION

FIELD OF THE INVENTION

The present invention pertains to an apparatus and method providing substantially two-dimensionally uniform irradiation of large areas with a high level of radiation. More particularly, the present invention pertains to an apparatus for and a method of uniformly projecting a high level of radiation onto a large planar target surface so as to uniformly treat the surface.

BACKGROUND OF THE INVENTION

Various manufacturing processes include treating a planar surface by irradiating the surface with, for example, ultraviolet light or other radiation. The radiation treatment may be related to curing, purification, disinfection, advanced oxidation or some other procedure. By way of example, manufacturing of printed circuit boards frequently involves forming conductive paths by a photoresist process in which a board treated with a photoresist in a desired pattern is irradiated as a part of a process to remove material from specified areas on the board. Similarly, in some printing processes a printed pattern is cured by irradiating the pattern. Obtaining a high quality, uniform product requires irradiating a two-dimensionally uniform high level of radiation over the entire target area. Otherwise irregularities in the finished product may result.

Existing devices often expose the central area of the irradiated surface to more radiation than the edge areas of the surface. The areas of high radiation may receive more than the desired level, possibly causing damage, while the areas of low radiation may be undertreated.

Various techniques have been used in the past to control the uniformity of irradiation of planar target surfaces. By way of example, U.S. Pat. No. 4,010,374 discloses an ultraviolet light processor including a primary light source which exposes a target surface on a work piece to ultraviolet light with the ultraviolet flux incident per unit area of the target surface greater at the central region of the surface than at edges of the surface, and a secondary light source which is positioned in a different plane than the primary light source and which exposes the target surface to ultraviolet light with the ultraviolet flux incident per unit area of the surface greater at the edge areas of the target surface than at the central region. Not only is such an ultraviolet light processor complex and expensive to manufacture and to operate, but also it is difficult to control in a manner that maintains the ultraviolet radiation received at the edge areas of the target surface from the secondary source at substantially the same level as the ultraviolet radiation received at the central area of the target surface from the primary source.

U.S. Pat. No. 4,276,479 discloses a tunnel type irradiation chamber with a plurality of cylindrical ultraviolet lenses through which an object to be treated is conveyed. Two sets of radiation sources, providing light of two different wavelengths, are within the chamber, providing light in two stages. Not only is this apparatus complex to control, but also it does not provide uniform radiation distribution on the object surface.

U.S. Pat. No. 4,348,015 shows a radiation projection system including complex lenses in order to provide uniform irradiance. Numerous other systems have been attempted. These generally are complex and expensive, both to construct and to operate. Even so, they generally have difficulty in achieving uniform irradiance, particularly two-dimensionally uniform irradiance.

SUMMARY OF THE INVENTION

The present invention is an apparatus for and a method of providing substantially two-dimensionally uniform irradiation of large areas with a high level of radiation. In accordance with the present invention at least two substantially identical sources of radiation are provided for producing radiation to irradiate a target surface. Each source may include an elongated discharge bulb. Each bulb is arranged within a corresponding elongated elliptical reflecting trough, with the bulb being spaced from the focal axis within the trough. The troughs, with the radiation sources in them, are positioned side by side in a plane substantially parallel to a planar target surface. Preferably, planar reflectors extend from the troughs to the target surface, being pivotally attached to the troughs so as to accommodate various sizes of target surfaces. Preferably also, planar reflectors extend from the interior longitudinal edges of the troughs, the inner reflectors being pivotally attached to the troughs to permit adjustment of the angular position of the inner reflectors so as to optimize the uniformity of the radiation distribution on the target surface. Each of the sources of radiation can be a light source, preferably a source of ultraviolet light such as a microwave electrodeless discharge bulb, an arc discharge bulb, or a fluorescent discharge bulb, for example.

In a preferred embodiment of the present invention, the positions of the troughs are adjustable in the direction of the minor axes of the ellipses defining the troughs, likewise aiding in optimization of the uniformity of the radiation distribution on the target surface.

DESCRIPTION OF THE DRAWINGS

These and other aspects and advantages of the present invention are more apparent from the following detailed description and claims, particularly when considered in conjunction with the accompanying drawings. In the drawings:

DETAILED DESCRIPTION OF PREFERRED EMBODIMENTS

Figure 1:
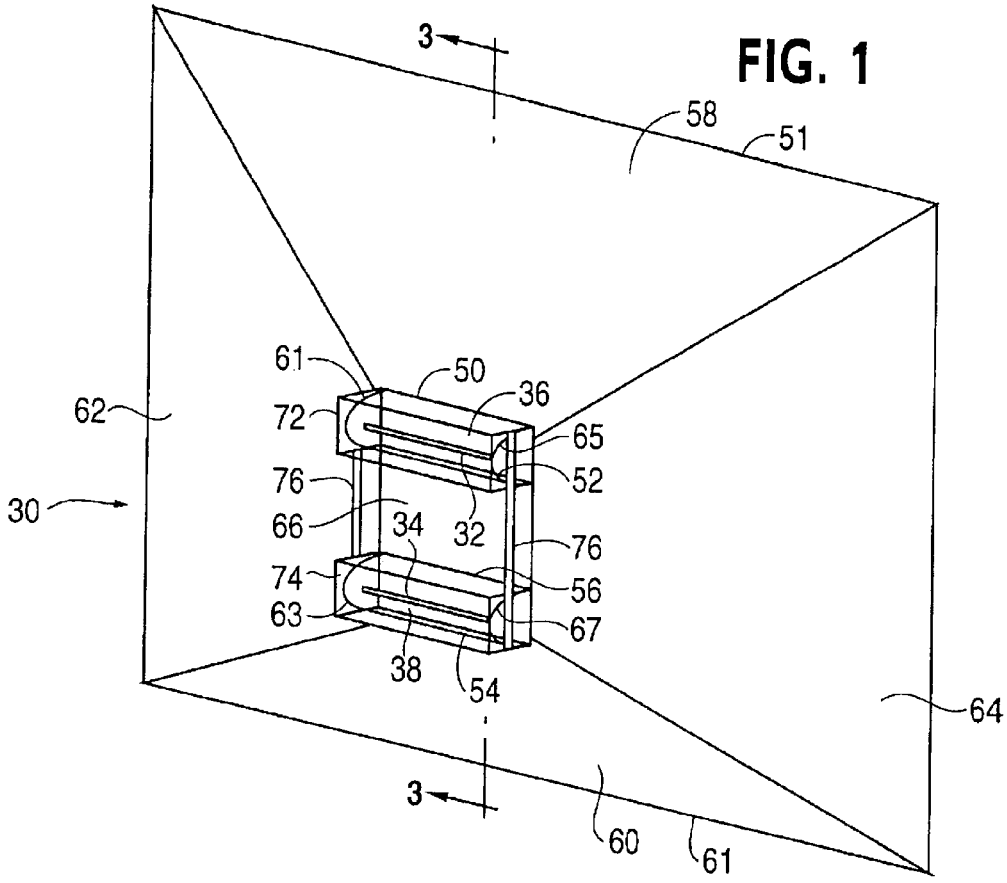
FIG. 1 is a rear perspective view of a first embodiment of an apparatus for providing substantially two-dimensionally uniform irradiation of a planar target surface in accordance with the present invention.
Figure 2:
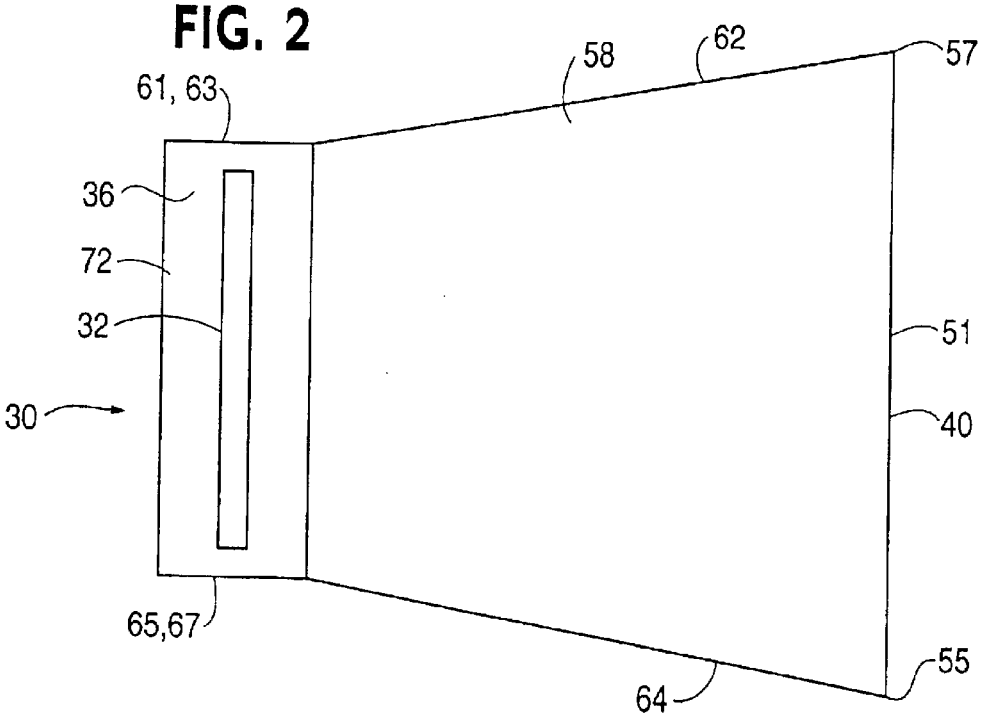
FIG. 2 is a top plan view of the apparatus of FIG. 1.

In the following description of the present invention, reference is made to the accompanying drawings which form a part hereof and in which are shown by way of illustration various embodiments in which the invention may be practiced. It is to be understood that other embodiments may be utilized, and that structural and functional modifications may be made without departing from the scope of the present invention.

FIGS. 1–4 depict a first embodiment of an irradiation apparatus 30 in accordance with the present invention. Apparatus 30 includes a first radiation source 32 and a substantially identical second radiation source 34, each of which is depicted as an elongated discharge bulb. By way of example, in a low power irradiation apparatus in accordance with the present invention, each radiation source 32, 34 might be a six-inch long, 2400-watt ultraviolet lamp, while in a higher power apparatus each source might be a 10 inch long, 6-kilowatt ultraviolet lamp. Radiation source 32 is positioned within an elongated elliptical reflecting trough 36, while radiation source 34 is positioned within a substantially identical trough 38. Each trough 36, 38 preferably is substantially one half of an ellipse, although each trough could be less or more than one half an ellipse if desired.

Radiation sources 32 and 34 irradiate a relatively large planar target surface 40. The longitudinal axes of radiation sources 32 and 34 define a plane which is substantially parallel to planar target surface 40. The ellipse of first trough 36 has a first focal point within the trough. The locus of the first focal point along the length of trough 36 thus defines a first focal axis 42 of the trough. The ellipse of first trough 36 has a second focal point outside the trough, the locus of which defines a second focal axis 44. Similarly, the ellipse of second trough 38 has a first focal point within the trough, the locus of which defines a first focal axis 46 of trough 38. Further, the ellipse of second trough 38 has a second focal point outside the trough, the locus of which defines a second focal axis 48. Each radiation source 32, 34 is spaced from the corresponding first focal axis 42, 46 at positions that result in optimum two-dimensional uniformity of the radiation distribution on target surface 40. By way of example, this might be a position toward target surface 40 by about ten percent of the focal length of the trough.

Figure 3:
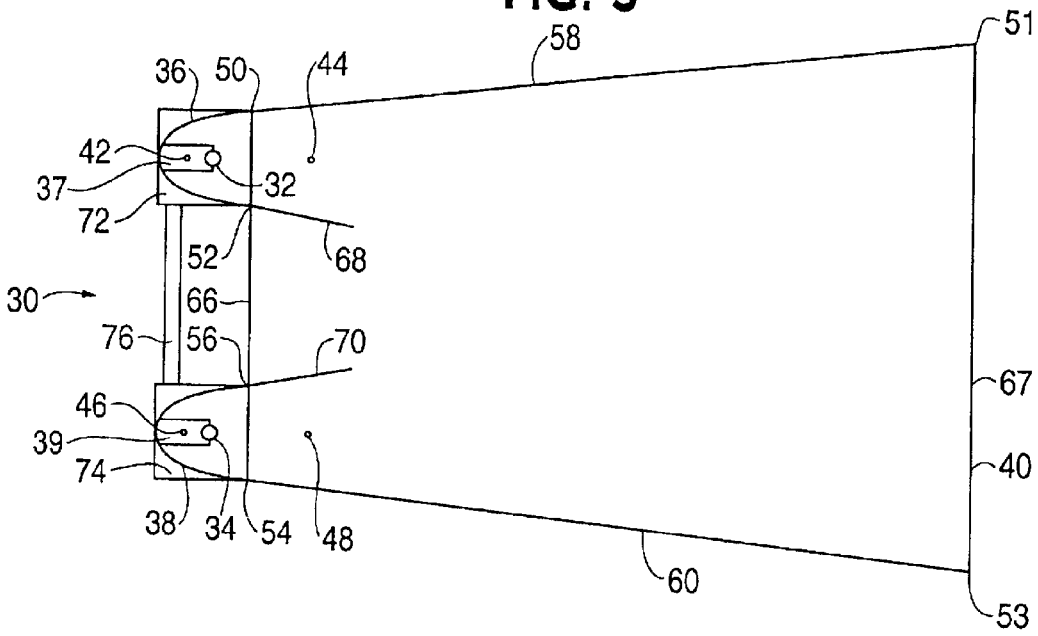
FIG. 3 is a schematic sectional view of the apparatus of FIG. 1 and is taken along line 3—3 in FIG. 1.

Preferably, each radiation source 32, 34 is mounted within its respective reflecting trough 36, 38 by an adjustable mount 37, 39 permitting adjustment of the position of each radiation source relative to the first focal axis of its respective elliptical reflecting trough, so as to optimize the uniformity of the radiation distribution on target surface 40. While FIG. 3 depicts radiation sources 32 and 34 positioned between focal axes 42 and 46 and target 40, the radiation sources could be on the side of the focal axes that is further from the target surface if such positions result in optimum uniformity of the radiation reaching the target surface. Preferably, each radiation source 32, 34 is on the major axis of the ellipse of its respective trough 36, 38.

Trough 36 terminates in an outer or first longitudinal edge 50 and an inner or second longitudinal edge 52. Similarly, trough 38 terminates in outer or first longitudinal edge 54 and inner or second longitudinal edge 56. A top reflector 58 extends from outer longitudinal edge 50 of first trough 36 to an end edge 51 which extends along the top edge of planar target surface 40. In like manner, a bottom reflector 60 extends from outer longitudinal edge 54 of second trough 38 to an end edge 53 which extends along the bottom edge of planar target surface 40. A first side reflector 62 extends from the first transverse edges 61, 63 of troughs 36 and 38 to an end edge 55 which extends along a first side edge of target surface 40. A second side reflector 64 extends from the second transverse edges 65, 67 of troughs 36 and 38 to an end edge 57 which extends along the second side edge of target surface 40. Preferably, reflectors 58–64 are pivotally connected to troughs 36 and 38 to permit accommodation of various sizes of target surfaces. The edges of the top and bottom reflectors 58, 60 and the side reflectors 62, 64 may be joined by flexible, rolled, or telescoping reflective material, if desired, to accommodate such pivoting. Preferably, also, the space between second longitudinal edges 52 and 56 of first trough 36 and second trough 38 is closed by a further reflector 66.

A first inner reflector 68 extends from inner or second longitudinal edge 52 of first trough 36, while a second inner reflector 70 extends from the inner or second edge 56 of second trough 38. Reflectors 68 and 70 might extend to or beyond the respective second focal axes 44 and 48, as desired, to obtain optimum uniformity of the radiation distribution on target surface 40. First inner reflector 68 might extend substantially parallel with bottom reflector 60, while second inner reflector 70 might extend substantially parallel with top reflector 58. However, preferably inner reflectors 68 and 70 are pivotally connected to inner longitudinal edges 52 and 56 to permit angular adjustment of the reflectors relative to the troughs so as to further optimize the uniformity of the radiation distribution on planar target surface 40.

Preferably, troughs 36 and 38 and their radiation sources 32 and 34 are movable in the direction of the minor axes of the troughs, permitting adjustment of the spacing between the two troughs, and thus between the two radiation sources 32 and 34, so as to permit further optimization of the uniformity of the radiation distribution on target surface 40. By way of example, first trough 36 may be mounted within a first housing 72 and second trough 38 mounted within a similar second housing 74. Housings 72 and 74 are adjustably mounted on supports 76, permitting movement of the troughs and radiation sources. Although in FIGS. 1–4 troughs 36 and 38, together with elongated discharge bulbs 32 and 34, are depicted as having their longitudinal axes extending horizontally, the axes could extend vertically or at an angle, if desired.

Figure 4:
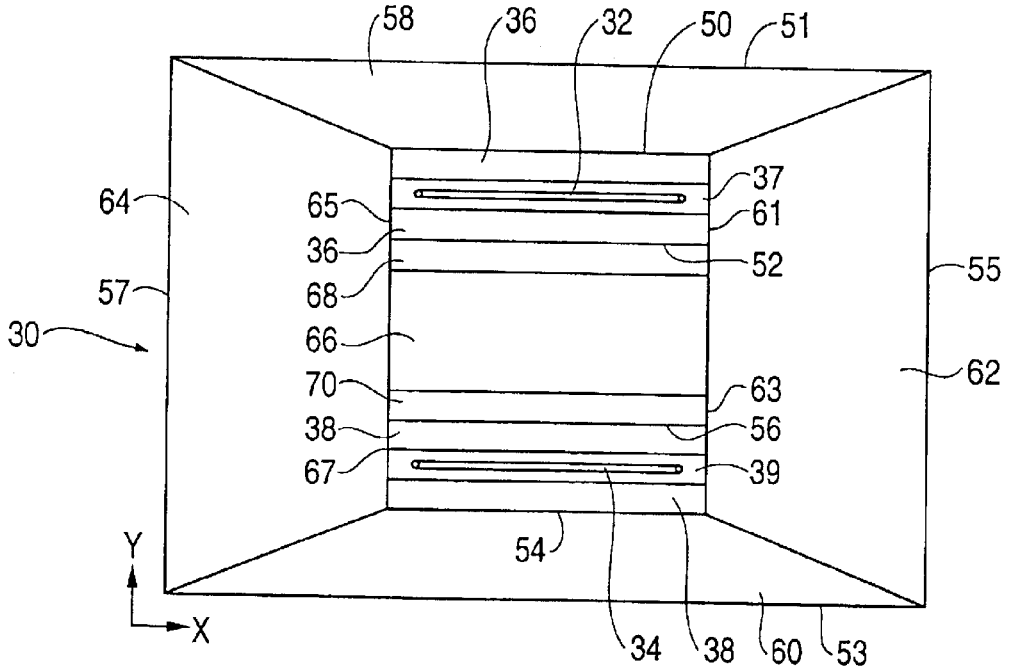
FIG. 4 is a front elevation view of the apparatus of FIG. 1.
Figure 6:
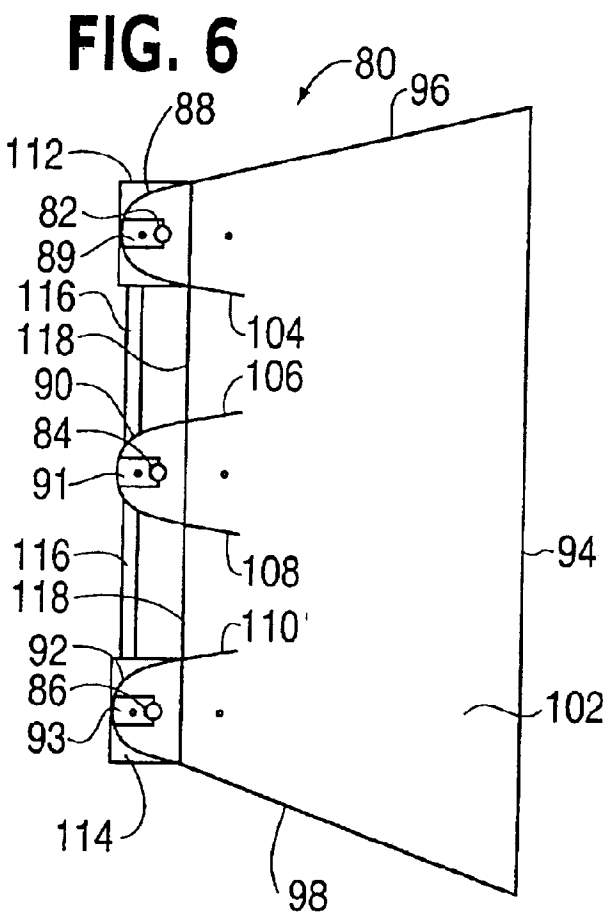
FIG. 6 is a schematic sectional view of the apparatus of FIG. 5 and is taken along the line 6—6 in FIG. 5.
Figure 5:
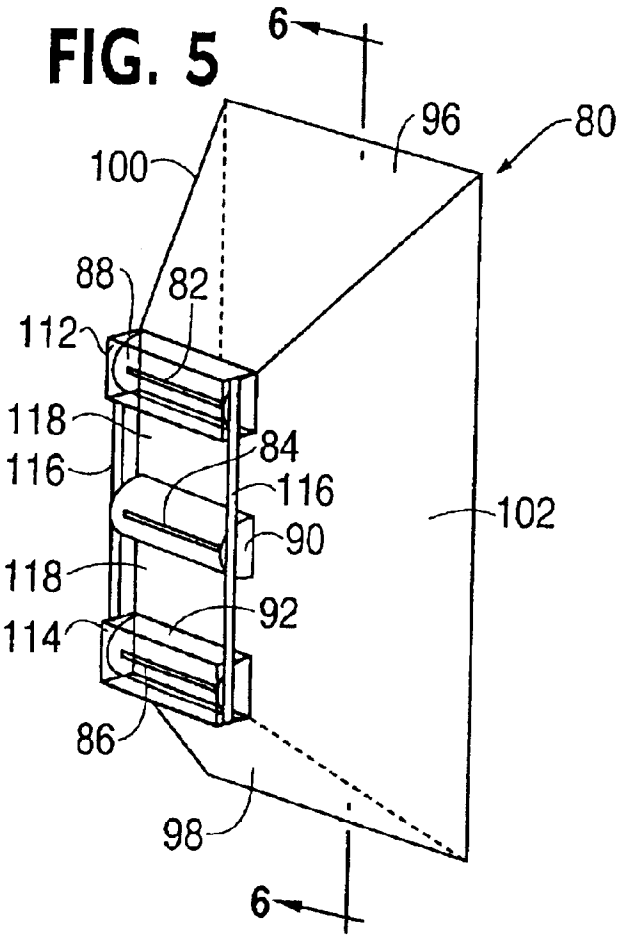
FIG. 5 is a rear perspective view of a second embodiment of an apparatus for providing substantially two-dimensionally uniform irradiation of a planar target surface in accordance with the present invention.
Figure 7:
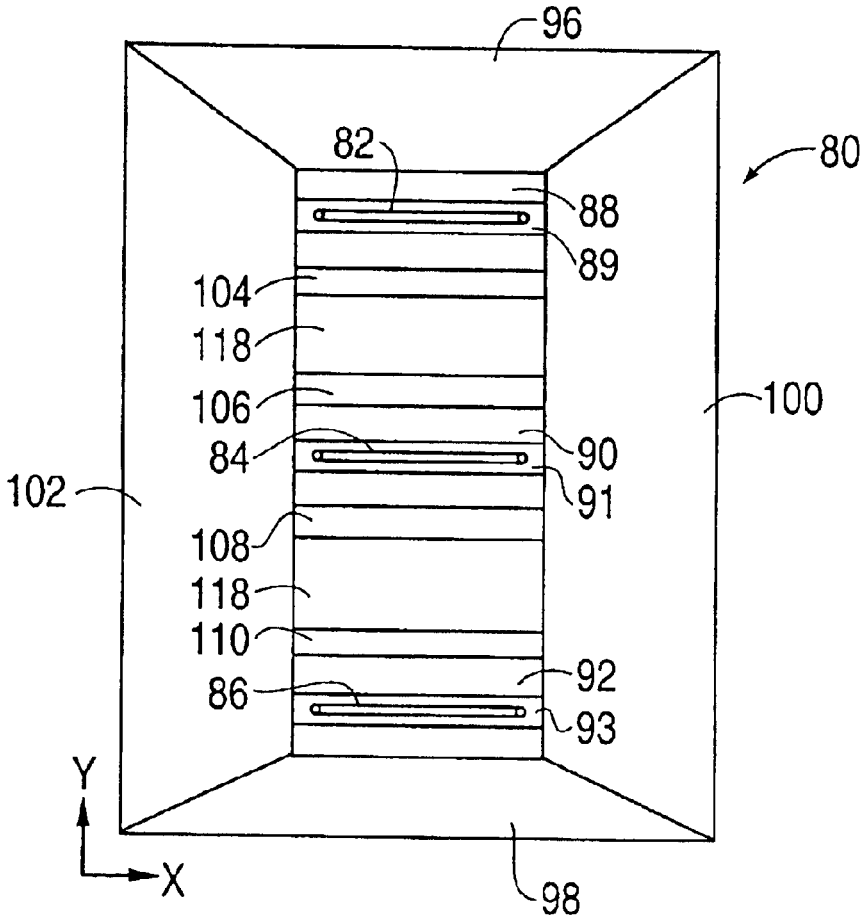
FIG. 7 is a front elevation view of the apparatus of FIG. 5.

FIGS. 5, 6, and 7 depict a second embodiment of an apparatus for providing substantially two-dimensionally uniform irradiation of a planar target surface in accordance with the present invention. FIGS. 5, 6, and 7 are respectively a rear perspective view, a schematic sectional view and a front elevational view of apparatus 80. The top plan view of apparatus 80 is substantially the same as FIG. 2. Apparatus 80 of FIGS. 5–7 differs from apparatus 30 of FIGS. 1–4 by having three radiation sources 82, 84, 86 mounted within respective elongated elliptical reflecting troughs 88, 90, 92. Radiation from sources 82, 84, 86 is directed toward a planar target surface 94. Apparatus 80 includes top and bottom reflectors 96 and 98, which extend from the first or outer longitudinal edges of troughs 88 and 92 to the top and bottom edges of target surface 94, and first and second side reflectors 100 and 102, which extend from the first and second transverse edges of troughs 88, 90, and 92 to the first and second side edges of target surface 94.

A first inner reflector 104 is mounted on the second or inner longitudinal edge of trough 88. A second inner reflector 106 is mounted on the first longitudinal edge of trough 84, while a third inner reflector 108 is mounted on the second longitudinal edge of trough 84. A fourth inner reflector 110 is mounted on the second or inner longitudinal edge of trough 92.

Preferably reflectors 96–102 are pivotally mounted to troughs 88–92 so as to accommodate target surfaces of different sizes. Preferably, also, reflectors 104–110 are pivotally mounted to the troughs to allow angular adjustment of the inner reflectors relative to the troughs so as to permit further optimization of the uniformity of the radiation distribution on target surface 94.

Radiation source 84 and its trough 90 are positioned substantially centrally of target surface 94 in the direction transverse to the longitudinal axis of the reflecting trough. Troughs 88 and 92 and their radiation sources 82 and 86 are preferably movable in the direction of the minor axes of the troughs, for example by being mounted within housings 112 and 114, respectively, with these housings adjustably mounted on supports 116. This permits further optimization of the uniformity of the radiation of target surface 94.

Preferably, the space between trough 88 and trough 90 and the space between trough 90 and trough 92 are closed by further reflectors 118, which might telescope to accommodate movement of troughs 88 and 92 as housings 112 and 114 move along supports 116.

The use of three radiation sources in respective troughs improves the uniformity of the radiation distribution on target 94. The uniformity can be further optimized by adjustment of the distance of the radiation sources from the elliptical axes of the respective troughs, the positions of troughs 88 and 92 and radiation sources 82 and 86, and the adjustment of the angular positions of inner reflectors 104–110.

Although in FIGS. 5–7 the longitudinal axes of radiation sources 82–86 and of troughs 88–92 are depicted as extending horizontally, they could extend vertically or at an angle, if desired.

The following examples, based on computer simulations, indicate the advantages of the present invention.

EXAMPLE 1

Figure 8:
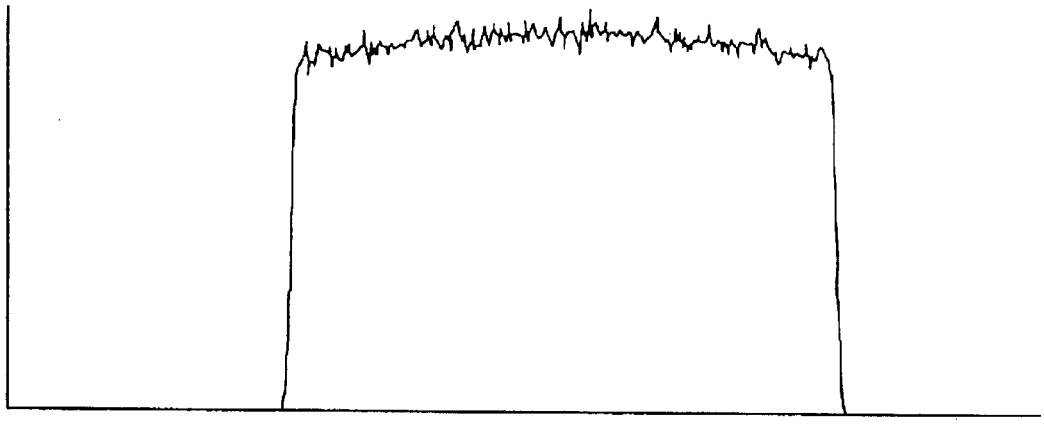
FIGS. 8 and 9 are graphs illustrating the operation of the apparatus of FIG. 1.
Figure 9:
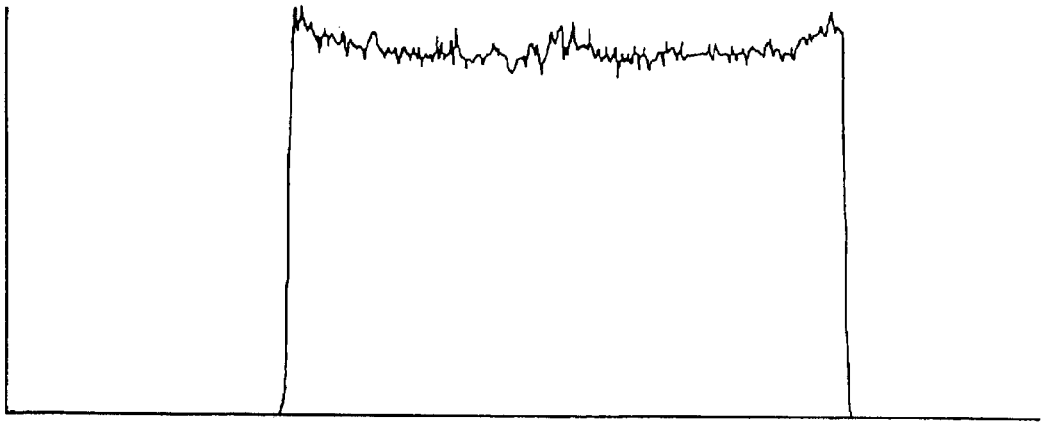

An apparatus in accordance with FIGS. 1–4 was simulated. The apparatus 30 includes first and second elongated irradiation sources 32 and 34, each of which is a ten inch, six-kilowatt tubular microwave powered ultraviolet discharge bulb. Each source 32, 34 is in an associated elongated elliptical reflecting trough 36, 38. Each trough is one-half of an ellipse having a major axis of approximately six inches and a minor axis of approximately four and one-fourth inches. Each radiation source 32, 34 is positioned on the major axis of the ellipse of its respective trough approximately 0.1 inch from its respective first focal axis 42, 46, which is a position found to provide optimum uniformity of radiation distribution on target surface 40. Target surface 40 is a 24 inch by 24 inch photosensitive film located approximately 24 inches from edges 50–56 of troughs 36 and 38. Reflectors 68 and 70 are pivoted to further optimize the uniformity of the radiation distribution. FIG. 8 depicts the horizontal or X direction distribution of the radiation reaching target 40, while FIG. 9 depicts the vertical or Y direction distribution. The X and Y directions are shown in FIG. 4. As can be seen from FIGS. 8 and 9, the distribution of the radiation is substantially uniform.

EXAMPLE 2

Figure 10:
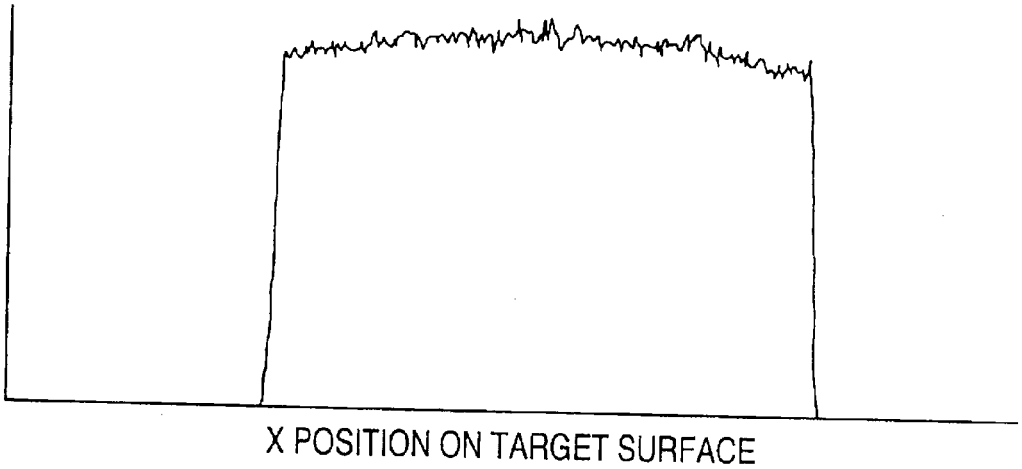
FIGS. 10 through 17 are graphs illustrating the operation of the apparatus of FIG. 5 with the radiation sources at various positions.
Figure 11:
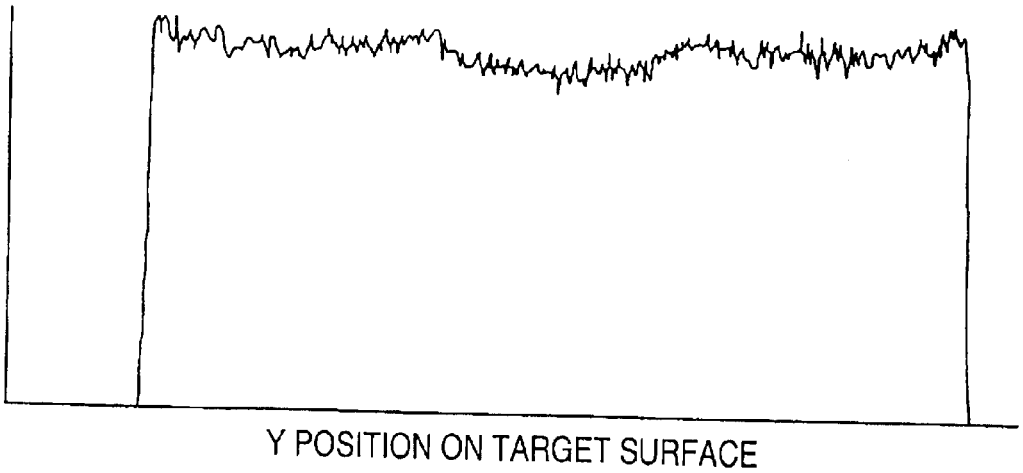

An apparatus having three radiation sources in three associated troughs, as depicted in FIGS. 5–7, was simulated. Each radiation source 82, 84, 86 is a ten inch, six-kilowatt tubular microwave powered ultraviolet discharge bulb. Each bulb 82, 84, 86 is in an associated elongated elliptical reflecting trough 88, 90, 92, the ellipse of which had a major axis of approximately six inches and a minor axis of approximately four and one-fourth inches. Troughs 88 and 92, together with their radiation sources 82 and 86, are positioned at locations approximately two-thirds of the distance from the center of trough 90 toward top reflector 96 and bottom reflector 98, respectively. Each radiation source is positioned on the major axis of its associated trough at a location found to provide optimum uniformity to the radiation distribution on target surface 94. Reflectors 104–110 are pivoted so as to further optimize the uniformity of the radiation distribution on target surface 94. The target surface is a photosensitive film which extends 24 inches in the X direction and 48 inches in the Y direction and is positioned approximately 24 inches from troughs 88–92. The X and Y directions are shown in FIG. 7. FIG. 10 depicts the horizontal or X direction distribution of the radiation reaching target surface 94, while FIG. 11 depicts the vertical or Y direction distribution. As can be seen from FIGS. 10 and 11, the radiation distribution on target surface 94 is substantially uniform.

EXAMPLE 3

Figure 12:
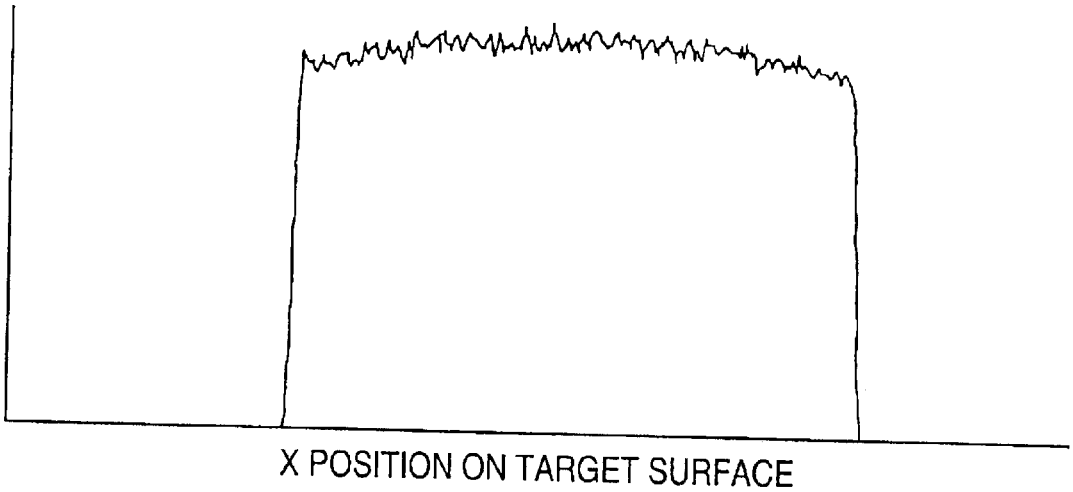
Figure 13:
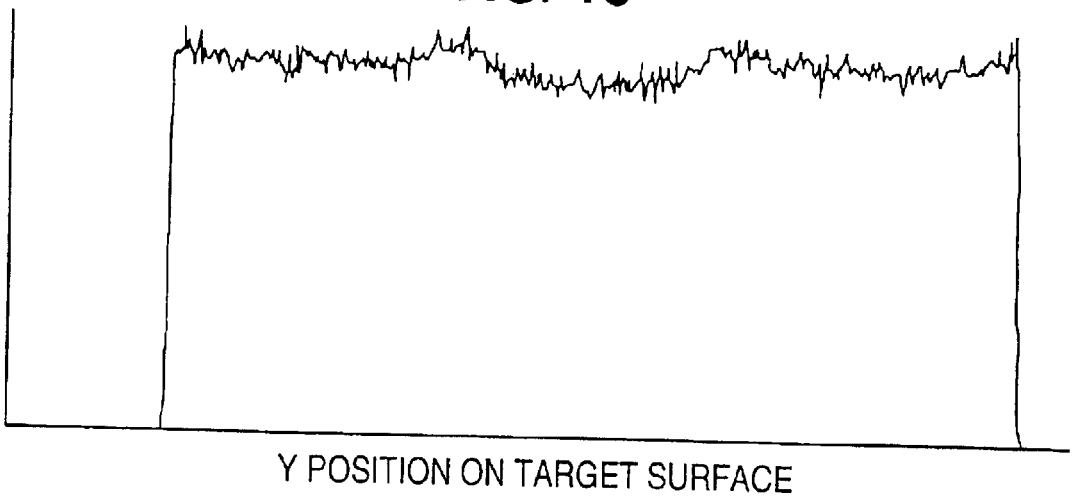

The simulated apparatus of Example 2 is adjusted by moving troughs 88 and 92 approximately one-fourth inch outward (i.e. toward top and bottom reflecting surfaces 96 and 98, respectively), as compared with the position of Example 2. Radiation sources 82, 84, and 86 are positioned within the troughs, and inner reflectors on 104–110 are pivoted so as to provide optimum uniformity to the radiation distribution on target surface 94. FIGS. 12 and 13 depict respectively the X direction radiation distribution and the Y direction radiation distribution. As can be seen, the radiation distribution is substantially uniform.

EXAMPLE 4

Figure 14:
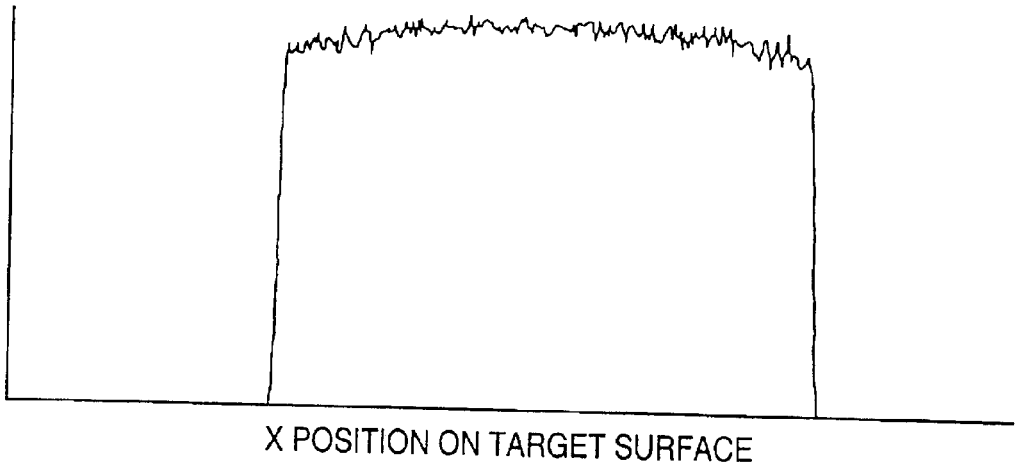
Figure 15:
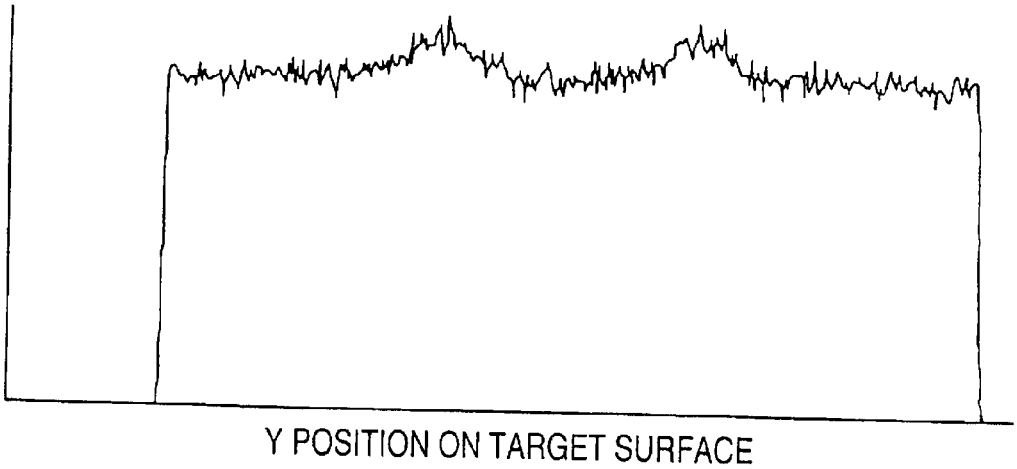

The simulated apparatus of Example 2 is adjusted by moving troughs 88 and 92 approximately one-half inch toward top reflector 96 and bottom reflector 98, respectively, as compared with the positions of Example 2. Again the radiation sources are positioned within the troughs, and the inner reflectors are pivoted to provide optimum uniformity to the radiation distribution on target surface 94. FIGS. 14 and 15 depict, respectively, the X direction distribution and the Y direction distribution. Again, it can be seen that the distribution is substantially uniform.

EXAMPLE 5

Figure 16:
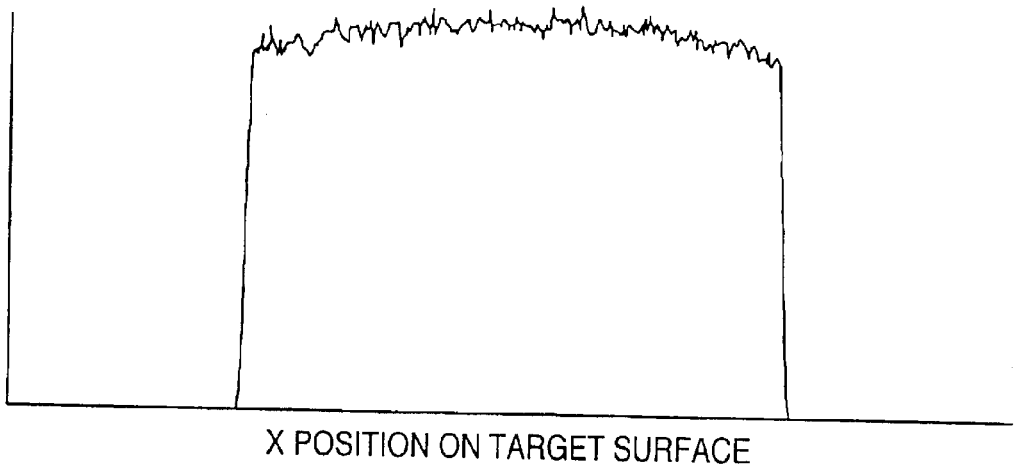
Figure 17:
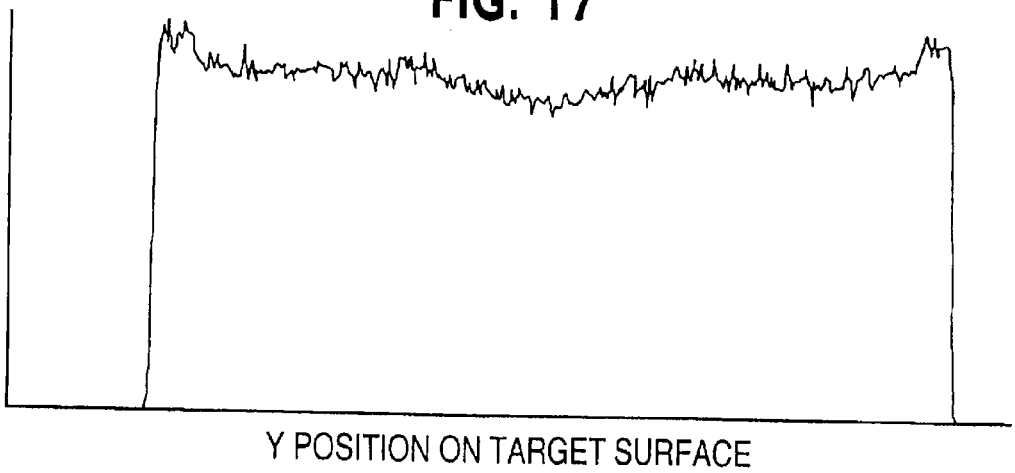

The apparatus of Example 2 is adjusted by moving troughs 88 and 92 approximately one-half inch inward from the positions of Example 2 (i.e. one half inch further from top reflector 96 and bottom reflector 98, respectively). The radiation sources are positioned within the troughs and the inner reflectors are pivoted to provide optimum uniformity to the radiation distribution on target surface 94. FIGS. 16 and 17 depict, respectively, the X direction radiation distribution and the Y direction radiation distribution on target surface 94. Once more it can be seen that the distribution is substantially uniform.

COMPARATIVE EXAMPLE

Figure 18:
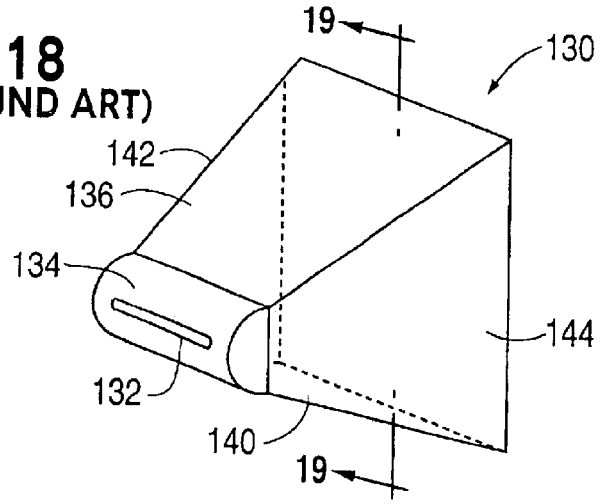
FIG. 18 (BACKGROUND ART)
FIG. 18 is a rear perspective view of an apparatus for irradiating a planar target surface, this apparatus having a single radiation source.
Figure 19:
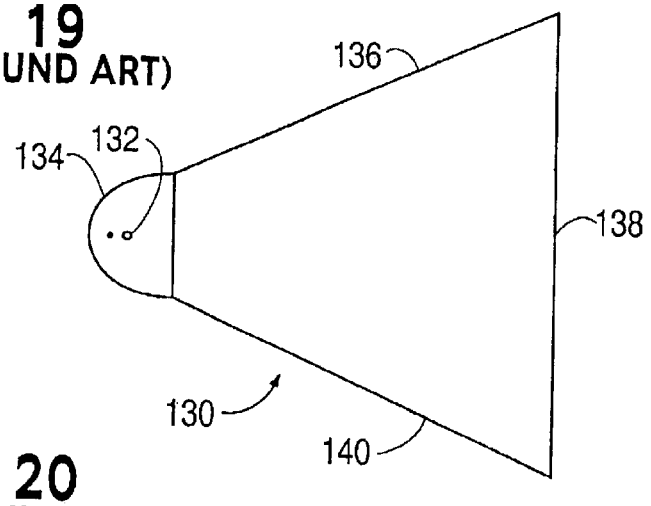
FIG. 19 (BACKGROUND ART)
FIG. 19 is a schematic sectional view of the apparatus of FIG. 18 and is taken along line 19—19 in FIG. 18.
Figure 20:
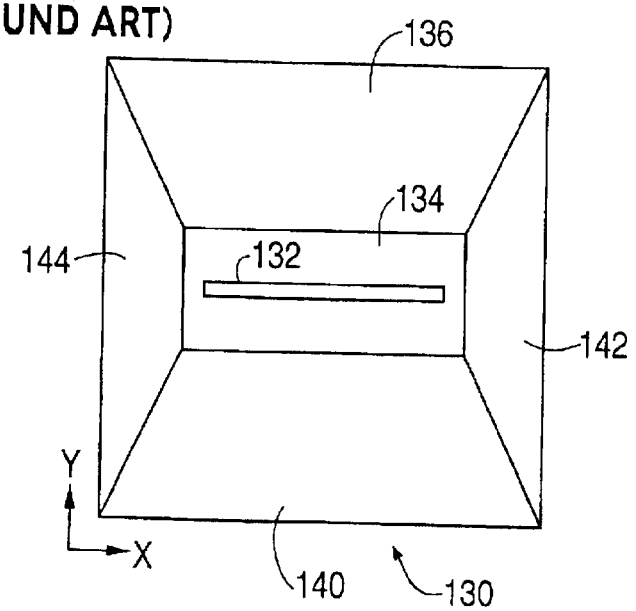
FIG. 20 (BACKGROUND ART)
FIG. 20 is a front elevation view of the apparatus of FIG. 18.

To show the improved performance of apparatus in accordance with the present invention, a comparative apparatus 130 having a single radiation source in a single trough, as depicted in FIGS. 18–20, was simulated. FIGS. 18–20 are respectively a perspective view, a schematic sectional view, and a front elevational view of apparatus 130. The top plan view is substantially the same as FIG. 2. Apparatus 130 includes an elongated radiation source 132 positioned within an elongated elliptical reflecting trough 134. A top reflector 136 extends from one longitudinal edge of trough 134 to a top edge of a target surface 138. Target surface 138 is a 24 inch by 24 inch photosensitive film positioned 24 inches from trough 134. A bottom reflector 140 extends from the second longitudinal edge of trough 134 to a bottom edge of target surface 138. First and second side reflectors 142 and 144 extend from the sides of trough 134 to the sides of target surface 138.

Figure 21:
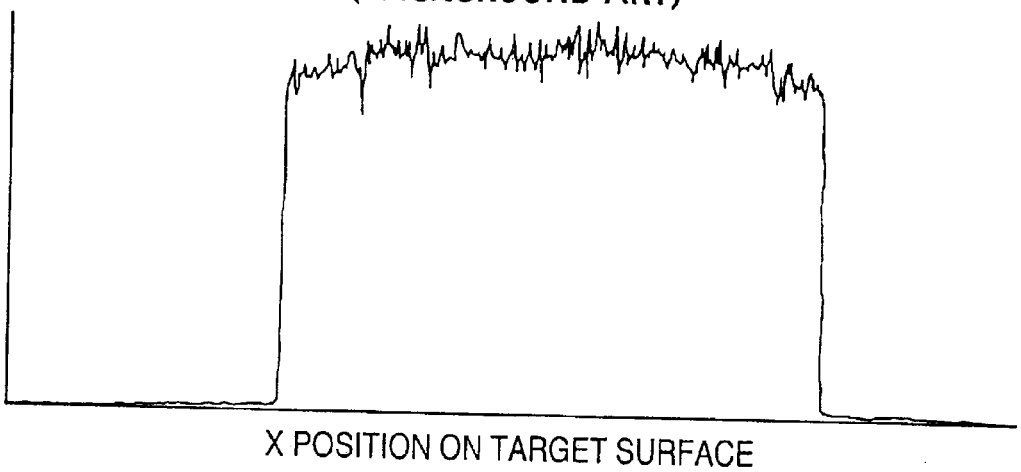
FIG. 21 (BACKGROUND ART)
FIGS. 21 and 22 are graphs illustrating the operation of the apparatus of FIG. 18.
Figure 22:
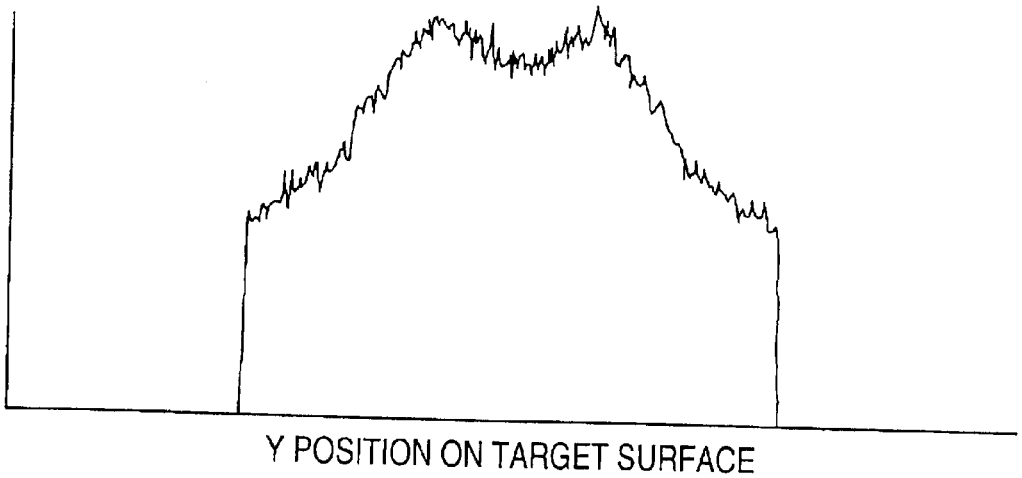
FIG. 22 (BACKGROUND ART)

Radiation source 132 is a ten inch, six-kilowatt ultraviolet electrodeless discharge bulb. Trough 134 is one-half of an ellipse having a major axis of approximately six inches and minor axis of approximately four and one-fourth inches. Radiation source 132 is positioned on the major axis at the location found to provide optimum achievable uniformity of the radiation distribution on target surface 138 FIG. 21 depicts the horizontal or X direction distribution of the radiation reaching target surface 138, while FIG. 22 depicts the vertical or Y direction distribution. The X and Y directions are shown in FIG. 20. While the X direction distribution is somewhat uniform, the Y direction distribution is clearly non-uniform. Both the apparatus of FIGS. 1–4 and the apparatus of FIGS. 5–7 provide improved two-dimensional uniformity of radiation distribution on a planar target surface, compared with the apparatus of FIGS. 18–20.

From Examples 2–5 and FIGS. 10–17, it can be seen that a positive shift moving troughs 88 and 92 and radiation sources 82 and 86 closer to top and bottom reflectors 96 and 98, raises the middle part and lowers the edges of the Y direction radiation distribution, while a negative shift, moving troughs 88 and 92 and radiation sources 82 and 86 further from top and bottom reflectors 82 and 86 raises the edges of the Y direction radiation distribution. Thus, by appropriate adjustment, the uniformity of the radiation distribution can be improved.

It can thus be seen that the present invention is an apparatus and method providing uniform irradiation of large areas with a high level of radiation. Although the present invention has been described with reference to preferred embodiments, various rearrangements, alterations, and substitutions might be made, and still the result would be within the scope of the invention.

What is claimed is:

1. Apparatus for providing substantially uniform irradiation of a relatively large planar target surface, said apparatus comprising:

at least two substantially identical sources of radiation for producing radiation to irradiate the target surface, each source of radiation having a longitudinal axis, the longitudinal axes being substantially parallel with each other to define a plane substantially parallel to the target surface; and means for reflecting light from said sources of radiation so that each source irradiates the target surface to add together the reflected light from each of said sources to provide said substantially uniform irradiation on the target surface, said means comprising at least two reflecting troughs, each trough having a major axis, a minor axis, a first focal axis within the trough and a second focal axis outside the trough, each of said sources of radiation being within a respective one of said troughs, on the major axis of the respective trough, and spaced from the first focal axis of the respective trough, each trough terminating in an opening defining a rectangular plane substantially perpendicular to the major axis of the trough and substantially parallel to the longitudinal axis of the respective source of radiation; and wherein each reflecting trough includes a section of an ellipse which reflects the light from one of the at least two substantially identical sources of radiation which irradiates the target surface.

2. Apparatus as claimed in claim 1, wherein each trough has at the trough opening first and second longitudinal edges and first and second transverse edges, and wherein said apparatus further comprises:

a substantially planar top reflector extending from the first longitudinal edge of said first trough to a first edge of the target surface;

a substantially planar bottom reflector extending from the first longitudinal edge of said second trough to a second edge of the target surface;

a first substantially planar side reflector extending from the first transverse edges of said first and second troughs to a third edge of the target surface; and a second substantially planar side reflector extending from the second transverse edges of said first and second troughs to a fourth edge of the target surface.

3. Apparatus as claimed in claim 2, further comprising a further reflector extending between the second longitudinal edges of said first and second troughs.

4. Apparatus as claimed in claim 2, comprising N sources of radiation and N elliptical troughs, where N is an integer greater than 1; said apparatus further comprising:

(N–1) first substantially planar inner reflectors, each first inner reflector extending from one of the longitudinal edges of a respective one of said troughs in a direction toward the target surface; and (N–1) second substantially planar inner reflectors, each second inner reflector extending from one of the longitudinal edges of a respective one of said troughs in a direction toward the target surface.

5. Apparatus as claimed in claim 4, further comprising mounts pivotally mounting each of said first and second planar inner reflectors to the respective longitudinal edge of the respective trough, permitting adjustment of the angular positions of said inner reflectors relative to said troughs.

6. Apparatus as claimed in claim 2, further comprising mounts pivotably mounting said top reflector, said bottom reflector, said first side reflector, and said second side reflector to the respective troughs, permitting adjustment of the angular positions of said top, bottom, and side reflectors relative to said troughs.

7. Apparatus as claimed in claim 1, wherein each of said at least two sources of radiation is an elongated discharge bulb.

8. Apparatus as claimed in claim 1, wherein said at least two sources of radiation ore light sources.

9. Apparatus as claimed in claim 8, wherein said light sources are sources of ultraviolet light.

10. Apparatus as claimed in claim 9, wherein said sources of ultraviolet light are microwave electrodeless discharge bulbs.

11. Apparatus as claimed in claim 10, wherein said bulbs are tubular bulbs.

12. Apparatus as claimed in claim 9, wherein said sources of ultraviolet light are arc discharge bulbs.

13. Apparatus as claimed in claim 9, wherein said sources of ultraviolet light are fluorescent discharge bulbs.

14. Apparatus as claimed in claim 1, wherein each of said sources of radiation is located on the major axis of the respective trough.

15. Apparatus as claimed in claim 1, wherein each trough includes a mount adjustably mounting the respective one of said sources or radiation for movement along the major axis of such trough.

16. Apparatus as claimed in claim 1, wherein each trough comprises an elongated elliptical trough.

17. Apparatus as claimed in claim 1, further comprising at least two mounts, each mount adjustably mounting one of said troughs for movement in the direction of the minor axes of said troughs.

18. A method of providing a substantially uniform two-dimensional radiation distribution on a planar target surface, said method comprising:

providing the structure of claim 5;

adjusting the angular positions of said inner reflectors relative to said troughs; and activating said sources of radiation.

19. A method of providing a substantially uniform two-dimensional radiation distribution on a planar target surface, said method comprising:

providing the structure of claim 6;

adjusting the angular positions of said top and bottom reflectors relative to said troughs; and activating said sources of radiation.

20. A method of providing a substantially uniform radiation distribution on a planar target surface, said method comprising:

providing the structure of claim 15;

adjusting the position of each of said sources of radiation along the major axis of the respective trough; and activating said sources of radiation.

21. A method of providing a substantially uniform radiation distribution on a planar target surface, said method comprising:

providing the structure of claim 17;

adjusting the position of each of said troughs in the direction of the minor axes of said elliptical troughs; and activating said sources of radiation.

22. An apparatus for irradiating a planar target surface, said apparatus comprising:

first and second substantially identical reflecting troughs, each reflecting trough extending longitudinally from a first end to a second end and having a transverse cross-section of a portion of an ellipse, each reflecting trough having a major axis, a minor axis, a focal axis, first and second longitudinal edges, and first and second traverse edges, said first end second reflecting troughs being positioned with their focal axes aligned to define a plane substantially perpendicular to the major axes of the ellipses;

a first radiation source having a longitudinal axis extending substantially parallel to the focal axis of the first reflecting trough, said first radiation source being within said first reflecting trough and spaced from the focal axis of the first reflecting trough;

a second, substantially identical, radiation source having a longitudinal axis extending substantially parallel to the focal axis of the second trough, said second radiation source being within said second reflecting trough and spaced from the focal axis of the second reflecting trough;

a first reflector extending from the first longitudinal edge of said first reflecting trough;

a second reflector extending from the first longitudinal edge of said second reflecting trough;

a third reflector extending from the first transverse edges of said first and second reflecting troughs;

a fourth reflector extending from the second transverse edges of said first and second reflecting troughs, wherein the first, second, third and fourth reflectors extend to respective end edges that define the plane of the target surface.

23. An apparatus as claimed in claim 22, further comprising a further reflector extending between the second longitudinal edges of said first and second reflecting troughs.

24. An apparatus as claimed in claim 22, further comprising:

a fifth reflector extending from the second longitudinal edge of said first reflecting trough; and a sixth reflector extending from the second longitudinal edge of said second reflecting trough.

25. An apparatus as claimed in claim 24, further comprising mounts, pivotally mounting said fifth and sixth reflectors to said first and second reflecting troughs, respectively, permitting adjustment of the angular positions of said reflectors relative to said reflecting troughs.

26. An apparatus as claimed in claim 22, further comprising mounts pivotally mounting said first, second, third, and fourth reflectors to said first and second reflecting troughs, permitting adjustment of the angular positions of said reflectors relative to said reflecting troughs.

27. An apparatus as claimed in claim 22, wherein each of said first and second radiation sources is an elongated discharge bulb.

28. An apparatus as claimed in claim 22, wherein said first and second radiation sources are light sources.

29. Apparatus as claimed in claim 28, wherein said light sources are sources of ultraviolet light.

30. Apparatus as claimed in claim 29, wherein said sources of ultraviolet light are microwave electrodeless discharge bulbs.

31. Apparatus as claimed in claim 30, wherein said bulbs are tubular bulbs.

32. Apparatus as claimed in claim 29, wherein said sources of ultraviolet light are arc discharge bulbs.

33. Apparatus as claimed in claim 29, wherein said sources of ultraviolet light are fluorescent discharge bulbs.

34. Apparatus as claimed in claim 22, wherein each of said radiation sources is located on the major axis of the respective reflecting trough.

35. Apparatus as claimed in claim 22, wherein each reflecting trough includes a mount adjustably mounting one of said radiation sources for movement along the major axis of such reflecting trough.

36. An apparatus as claimed in claim 22, further comprising first and second mounts mounting said first and second reflecting troughs for movement in the direction of the minor axis of said reflecting troughs.

37. An apparatus as claimed in claim 22, further comprising:

a third reflecting trough substantially identical to said first and second reflecting troughs, said third reflecting trough being positioned between said first and second reflecting troughs with the focal axis of said third reflecting trough lying aligned with the focal axes of said first and second reflecting troughs; and a third radiation source substantially identical to said first and second radiation sources, said third radiation source having a longitudinal axis extending substantially parallel to the focal axis of the third reflecting trough, said third radiation source being within said third reflecting trough and spaced from the focal axis of the third reflecting trough;

wherein said third and fourth reflectors extend from the first and second transverse edges, respectively, of said first, second, and third reflecting troughs.

38. Apparatus as claimed in claim 37, further comprising first end second further reflectors, said first further reflector extending between the second longitudinal edge of said first reflecting trough and the first longitudinal edge of said third reflecting trough; said second further reflector extending between the second longitudinal edge of said second reflecting trough and the second longitudinal edge of said third reflecting trough.

39. Apparatus as claimed in claim 37, further comprising:

a fifth reflector extending from the second longitudinal edge of said first reflecting trough;

a sixth reflector extending from the second longitudinal edge of said second reflecting trough;

a seventh reflector extending from the first longitudinal edge of said third reflecting trough; and an eighth reflector extending from the second longitudinal edge of said third reflecting trough.

40. An apparatus as claimed in claim 39, further comprising mounts, pivotally mounting said fifth, sixth, seventh and eighth reflectors to the respective reflecting troughs to permit adjustment of the angular positions of said fifth, sixth, seventh, and eighth reflectors relative to said reflecting troughs.

41. An apparatus as claimed in claim 37, further comprising mounts pivotally mounting said first, second, third, and fourth reflectors to said first, second, and third reflecting troughs to permit adjustment of the angular positions of said reflectors relative to said reflecting troughs.

42. An apparatus as claimed in claim 37, wherein each of said radiation sources is an elongated discharge bulb.

43. An apparatus as claimed in claim 37, wherein said first, second and third radiation sources are light sources.

44. Apparatus as claimed in claim 43, wherein said light sources are sources of ultraviolet light.

45. Apparatus as claimed in claim 44, wherein said sources of ultraviolet light are microwave electrodeless discharge bulbs.

46. Apparatus as claimed in claim 45, wherein said bulbs are tubular bulbs.

47. Apparatus as claimed, in claim 44, wherein said sources of ultraviolet light are arc discharge bulbs.

48. Apparatus as claimed in claim 44, wherein said sources of ultraviolet light are fluorescent discharge bulbs.

49. Apparatus as claimed in claim 37, wherein each of said radiation sources is located on the major axis of the respective reflecting trough.

50. Apparatus far irradiating a target of variable surface area defined by an opening from which light is output comprising:

a housing comprising a bottom and light reflective sides extending away from and diverging from the bottom of the opening which are moveable to vary the surface area of the opening;

a plurality of spaced apart curved light reflective troughs disposed at the bottom;

at least one light reflective surface, each light reflective surface being disposed at the bottom and between an adjacent pair of curved light reflective troughs;

a plurality of longitudinally extending sources of light, each longitudinally extending source of light extending substantially parallel to a longitudinal axis of an associated one of the plurality of spaced apart curved light reflective troughs; and a plurality of light mounts, each light mount fixing a different one of the plurality of longitudinally extending sources of light relative to an associated curved light reflective trough during irradiation of the target surface while providing a selection of a position of the longitudinally extending source of light relative to a bottom of the associated curved light reflective trough to vary light irradiation of the target surface.

51. Apparatus as claimed in claim 50 wherein:

the sides extending away from the bottom are pivotable relative to the bottom to vary the surface area of the opening.

52. Apparatus as claimed in claim 50 wherein:

an adjustment mechanism for varying spacing between the troughs relative to the bottom.

53. Apparatus as claimed in claim 51 wherein:

an adjustment mechanism for varying spacing between the troughs relative to the bottom.

54. Apparatus as claimed in claim 50 wherein:

a pair of the plurality of spaced apart curved light reflective troughs each comprise an outer edge;

an opposite pair of the light reflective sides each comprise an inner edge and an outer edge which in part defines the opening; and the outer edge of one of the pair of spaced apart curved reflective troughs is joined to one of the inner edges of the pair of the light reflective sides and the outer edge of another one of the pair of spaced apart curved reflective troughs is joined to another one of the inner edges of the pair of light reflective sides.

55. Apparatus as claimed in claim 51 wherein:

a pair of the plurality of spaced apart curved light reflective troughs each comprise an outer edge;

an opposite pair of the light reflective sides each comprise an inner edge and an outer edge which in part defines the opening; and the outer edge of one of the pair of spaced apart curved reflective troughs is joined to one of the inner edges of the pair of the light reflective sides and the outer edge of another one of the pair of spaced apart curved reflective troughs is joined to another one of the inner edges of the pair of light reflective sides.

56. Apparatus as claimed in claim 52 wherein:

a pair of the plurality of spaced apart curved light reflective troughs each comprise an outer edge;

an opposite pair of the light reflective sides each comprise an inner edge and an outer edge which in part defines the opening; and the outer edge of one of the pair of spaced apart curved reflective troughs is joined to one of the inner edges of the pair of the light reflective sides and the outer edge of another one of the pair of spaced apart curved reflective troughs is joined to another one of the inner edges of the pair of light reflective sides.

57. Apparatus as claimed in claim 53 wherein:

a pair of the plurality of spaced apart curved light reflective troughs each comprise an outer edge;

an opposite pair of the light reflective sides each comprise an inner edge and an outer edge which in part defines the opening; and the outer edge of one of the pair of spaced apart curved reflective troughs is joined to one of the inner edges of the pair of the light reflective sides and the outer edge of another one of the pair of spaced apart curved reflective troughs is joined to another one of the inner edges of the pair of light reflective sides.

58. Apparatus as claimed in claim 54 wherein:

at least a pair of the plurality of spaced apart curved light reflective troughs each comprise at least one inner edge; and light reflective extensions are respectively joined to the inner edge of a different one of the at least a pair of the plurality of spaced apart curved light reflective troughs to provide a light reflective extension of the curved light reflective troughs within the housing.

59. Apparatus as claimed in claim 55 wherein:

at least a pair of the plurality of spaced apart curved light reflective troughs each comprise at least one inner edge; and light reflective extensions are respectively joined to the inner edge of a different one of the at least a pair of the plurality of spaced apart curved light reflective troughs to provide a light reflective extension of the curved light reflective troughs within the housing.

60. Apparatus as claimed in claim 56 wherein:

at least a pair of the plurality of spaced apart curved light reflective troughs each comprise at least one inner edge; and light reflective extensions are respectively joined to the inner edge of a different one of the at least a pair of the plurality of spaced apart curved light reflective troughs to provide a light reflective extension of the curved light reflective troughs within the housing.

61. Apparatus as claimed in claim 57 wherein:

at least a pair of the plurality of spaced apart curved light reflective troughs each comprise at least one inner edge; and light reflective extensions are respectively joined to the inner edge of a different one of the at least a pair of the plurality of spaced apart curved light reflective troughs to provide a light reflective extension of the curved light reflective troughs within the housing.

62. Apparatus as claimed in claim 50 wherein:

the plurality of spaced apart curved light reflective troughs comprise an elliptical section with foci and the longitudinally extended source of light associated with each curved light reflective trough is located between the foci of the elliptical section.

63. Apparatus as claimed in claim 51 wherein:

the plurality of spaced apart curved light reflective troughs comprise an elliptical section with foci and the longitudinally extended source of light associated with each curved light reflective trough is located between the foci of the elliptical section.

64. Apparatus as claimed in claim 52 wherein:

the plurality of spaced apart curved light reflective troughs comprise an elliptical section with foci and the longitudinally extended source of light associated with each curved light reflective trough is located between the foci of the elliptical section.

65. Apparatus as claimed in claim 53 wherein:

the plurality of spaced apart curved light reflective troughs comprise an elliptical section with foci and the longitudinally extended source of light associated with each curved light reflective trough is located between the foci of the elliptical section.

66. Apparatus as claimed in claim 54 wherein:

the plurality of spaced apart curved light reflective troughs comprise an elliptical section with foci and the longitudinally extended source of light associated with each curved light reflective trough is located between the foci of the elliptical section.

67. Apparatus as claimed in claim 55 wherein:

the plurality of spaced apart curved light reflective troughs comprise an elliptical section with foci and the longitudinally extended source of light associated with each curved light reflective trough is located between the foci of the elliptical section.

68. Apparatus as claimed in claim 56 wherein:

the plurality of spaced apart curved light reflective troughs comprise an elliptical section with foci and the longitudinally extended source of light associated with each curved light reflective trough is located between the foci of the elliptical section.

69. Apparatus as claimed in claim 57 wherein:

the plurality of spaced apart curved light reflective troughs comprise an elliptical section with foci and the longitudinally extended source of light associated with each curved light reflective trough is located between the foci at the elliptical section.

70. Apparatus as claimed in claim 58 wherein:

the plurality of spaced apart curved light reflective troughs comprise an elliptical section with foci and the longitudinally extended source of light associated with each curved light reflective trough is located between the foci of the elliptical section.

71. Apparatus as claimed in claim 59 wherein:

the plurality of spaced apart curved light reflective troughs comprise an elliptical section with foci and the longitudinally extended source of light associated with each curved light reflective trough is located between the foci of the elliptical section.

72. Apparatus as claimed in claim 60 wherein:

the plurality of spaced apart curved light reflective troughs comprise an elliptical section with foci and the longitudinally extended source of light associated with each curved light reflective trough is located between the foci of the elliptical section.

73. Apparatus as claimed in claim 61 wherein:

the plurality of spaced apart curved light reflective troughs comprise an elliptical section with foci and the longitudinally extended source of light associated with each curved light reflective trough is located between the foci of the elliptical section.

74. Apparatus for irradiating a target of variable surface area defined by an opening from which light is output comprising:

a housing comprising a bottom and light reflective sides extending away from and diverging from the bottom of the opening which are moveable to vary the surface area of the opening;

a plurality of spaced apart curved light reflective troughs disposed at the bottom;

a plurality of longitudinally extending sources of light, each longitudinally extending source of light extending substantially parallel to a longitudinal axis of an associated one of the plurality of spaced apart curved light reflective troughs; end a plurality of light mounts, each light mount fixing a different one of the plurality of longitudinally extending sources of light relative to an associated curved light reflective trough during irradiation of the target surface while providing a selection of a position of the longitudinally extending source of light relative to a bottom of the associated curved light reflective trough to vary light irradiation of the target surface.

* * * * *